United States Patent [19]

Ogura

[11] 4,449,912

[45] May 22, 1984

[54] APPARATUS FOR THE AUTOMATIC EJECTION OF CONCRETE PIPES

[76] Inventor: Mitsuharu Ogura, 1192, Enza-cho, Takamatsu, Kagawa, Japan

[21] Appl. No.: 435,988

[22] Filed: Oct. 22, 1982

[51] Int. Cl.[3] ..... B28B 13/06

[52] U.S. Cl. ..... 425/444; 249/100; 425/427

[58] Field of Search ..... 249/100; 425/441, 427, 425/444

[56] References Cited

U.S. PATENT DOCUMENTS

| | | | |
|---|---|---|---|
| 3,119,165 | 1/1964 | Gourlie | 425/427 |
| 3,341,910 | 9/1967 | Hesselholt | 249/100 |
| 3,419,649 | 12/1968 | Livingston et al. | 425/441 |
| 3,500,514 | 3/1970 | Ruegsegger | 425/444 |
| 3,660,003 | 5/1972 | Waddington | 425/427 |
| 4,118,165 | 10/1978 | Christian | 425/427 |

*Primary Examiner*—Thomas P. Pavelko
*Assistant Examiner*—James C. Housel
*Attorney, Agent, or Firm*—Armstrong, Nikaido, Marmelstein & Kubovcik

[57] ABSTRACT

An apparatus for manufacturing concrete pipes having a molding flask provided with a specially formed end ring on the bell end side. The apparatus further includes a device for detaching this end ring and another device disposed at the spigot end side and allotted for thrusting a hardened concrete pipe out of the molding flask.

3 Claims, 7 Drawing Figures

APPARATUS FOR THE AUTOMATIC EJECTION OF CONCRETE PIPES

The present invention relates to an apparatus for manufacturing concrete pipes.

In case of the conventional apparatuses of this kind, the work of releasing a hardened concrete pipe from a molding flask has had to be done by hand labor.

It is an object of the present invention to provide an apparatus which frees the workers from the painstaking hand labor in releasing a hardened concrete pipe from a molding flask.

It is another object of the present invention to provide an apparatus in which molding flasks of various diameters can be used.

With these objects in view, the present invention will become apparent from the following detailed description, which will be more clearly understood in connection with the accompanying drawings.

An apparatus in accordance with the present invention comprises a molding flask A in which a concrete pipe B is to be formed, a device 28 to be disposed at the bell end side of the concrete pipe B, and a device 39 to be disposed at the spigot end side of the concrete pipe B.

Figure 1:
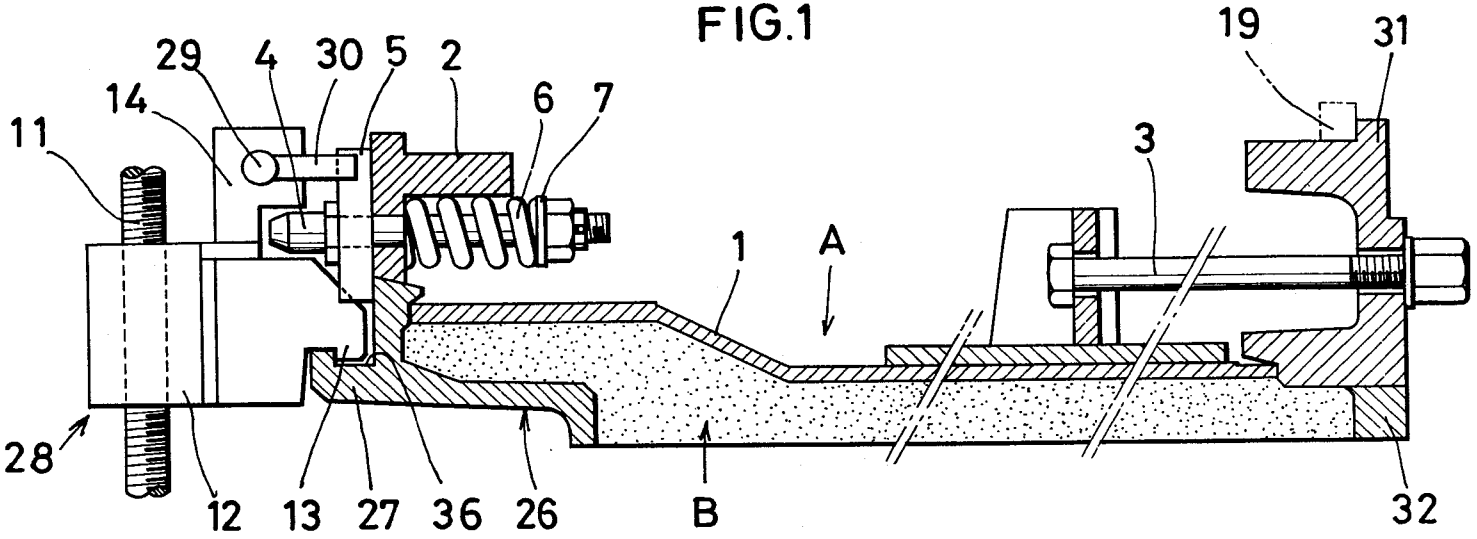
FIG. 1 is a longitudinal sectional view of the apparatus of the present invention.
Figure 2:
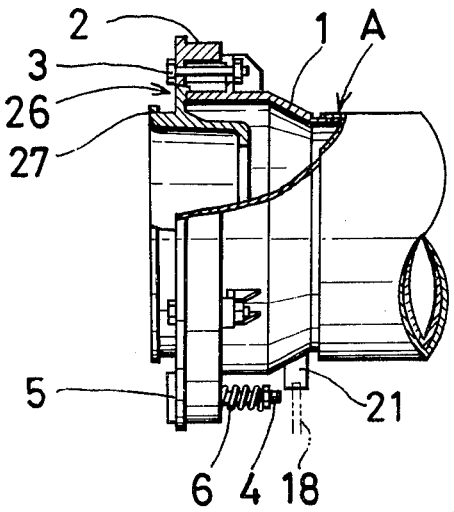
FIG. 2 is a partially cutaway side view of a part of a molding flask to be used in the apparatus of the present invention.
Figure 3:
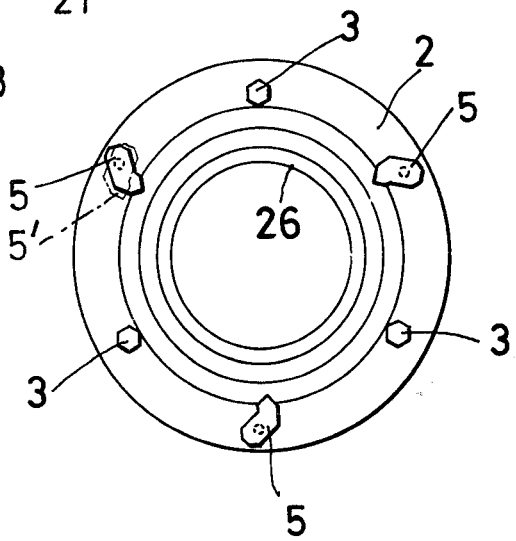
FIG. 3 is a front view thereof.

Referring now to FIGS. 1, 2 and 3, the molding flask A includes a cylindrical body 1, a flange 2 secured to the bell end of the cylindrical body 1 by means of a plurality of bolts 3, a plurality of bolts 4 inserted through the flange 2 so as to allow the axis of each bolt 4 to run parallel with the axis of the cylindrical body 1, a clasp 5 rotatably fitting on each bolt 4 in abutment with the outside annular shoulder of the flange 2, a spring 6 fitting over each bolt 4 with its one end in abutment with a washer 7 positioned in the proximity of the end of the bolt 4 and with the other end of the spring 6 seated in abutment with the inside annular shoulder of the flange 2 so as to press the clasp 5 against the outside annular shoulder of the flange 2, and an end ring 26 fitting in the flange 2 and held in place by means of the clasps 5. The end ring 26 has an outwardly projecting portion 27.

Figure 5:
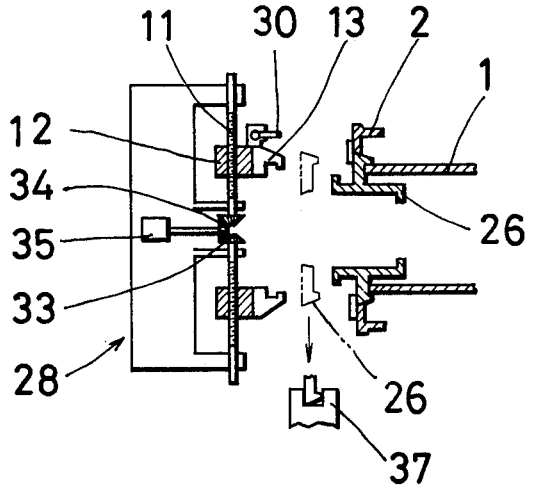
FIG. 5 is a longitudinal sectional view of a part of the apparatus of the present invention.
Figure 6:
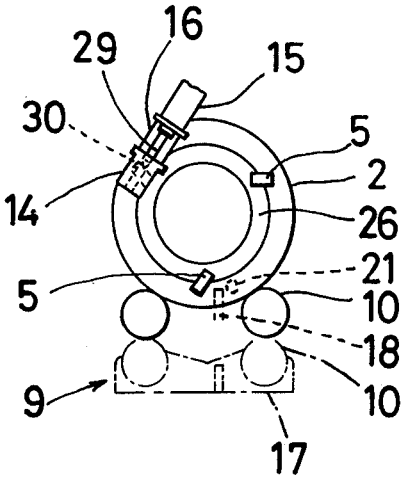
FIG. 6 is a front view thereof.

Referring now to FIGS. 1, 5 and 6, the device 28, which is allotted for detaching the end ring 26 from the hardened concrete pipe B, is capable of reciprocation in the axial direction of the molding flask A. The device 28 includes a plurality of threaded bolts 11 arranged radially like the spokes of a wheel in such a manner that a plane formed thereby is made perpendicular to the axis of the molding flask A and that the extension of the axis of the molding flask A passes through the point where the axes of the threaded bolts 11 intersect. An adjustable jaw 12, which is a perforated block having an internal screw thread, engages each threaded bolt 11 at right angles thereto. The hook-shaped end 13 of the adjustable jaw 12 points to the axis of the molding flask A.

Each threaded bolt 11 is provided with a bevel gear 33 on the end located toward the point where the axes of the threaded bolts 11 intersect. The bevel gears 33 are adapted to be turned all together by another bevel gear 34 provided on the outside end of the rotor shaft of an air motor 35 so that the adjustable jaws 12 may be moved all together at the same speed toward or away from the bevel gears 33.

On the side remote from the axis of the molding flask A, each adjustable jaw 12 is provided with a bracket 14 designed to support a means for giving a kick at the clasp 5, which means includes a hydraulic cylinder 15 secured to the bracket 14 by brackets 16 so as to allow the axis of the hydraulic cylinder 15 to run parallel with the outside annular shoulder of the flange 2, a piston 29 adapted to be pushed out of, and drawn into, the hydraulic cylinder 15, and a hook-shaped piece 30 provided on the outside end of the piston 29 so as to point to the outside annular shoulder of the flange 2. The height of the bracket 14 and the length of the piece 30 are determined so that, when the hook-shaped end 13 engages with an annular groove 36 provided in the outwardly projecting portion 27 of the end ring 26, each clasp 5 can be caught by each piece 30 at a point located toward the edge of the outside annular shoulder of the flange 2.

Referring now to FIGS. 1 and 2, the molding flask A further includes a flange 31 designed to form the spigot end of the concrete pipe B and secured, by means of a plurality of bolts 3, to the position where the spigot end of the concrete pipe B is to be formed. An end ring 32, which is equal in outside diameter to the spigot end of the concrete pipe B to be formed, fits in the flange 31 and may be held in place by a means similar to the clasps 5.

The device 39, which is allotted for thrusting the hardened concrete pipe B out of the molding flask A, includes a cylinder 20 disposed coaxially with the end ring 32 and provided with a spout 40, a piston 22 adapted to be pushed out of, or drawn into, the cylinder 20 by hydraulic means, and a circular push plate 23 provided on the outside end of the piston 22 coaxially therewith and having a slightly smaller diameter than the outside diameter of the end ring 32. The spout 40 pivotally carries two hooks 41 on two pins 42, respectively, so that push or pull exerted on rods 43 in their axial direction will pivot the hooks 41.

Figure 4:
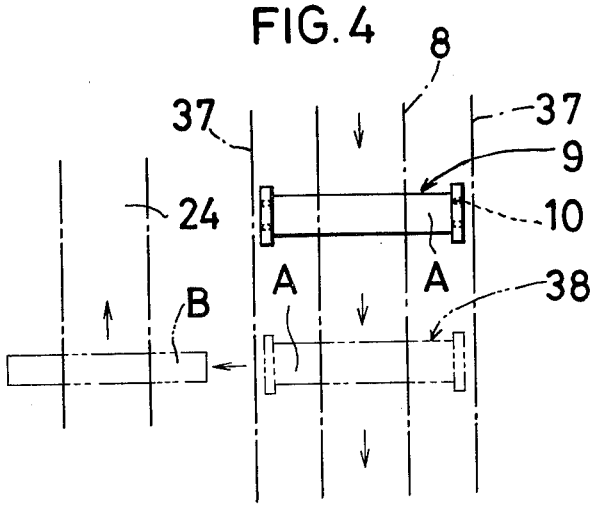
FIG. 4 is a schematic plan view of assistance in explaining the operation of the invention.

In operation, the molding flask A, in which a concrete pipe B has been formed, is carried to a first workshop 9 by means of a conveyor 8 as shown in FIG. 4. At the workshop 9, a plurality of rollers 10 mounted on roller frames 17 are raised to the level required for supporting the molding flask A as shown in FIG. 6. Then the molding flask A is rotated by rotating the rollers 10 until a positioning pin 18 provided on the roller frame 17 strikes against a lug 21 provided on the outside surface of the molding flask A.

Then the adjustable jaws 12 are positioned so as to make the hook-shaped ends 13 ready for engaging with the annular groove 36. Then the device 28 is moved to the right-hand end of the stroke as shown in FIG. 1, and the hook-shaped ends 13 are allowed to engage with the annular groove 36. Then the pistons 29 are pushed out of the hydraulic cylinders 15 so as to allow the hook-shaped pieces 30 to give a kick at the clasps 5, which are thereby subjected to angular motion in the position designated by the numeral 5' in FIG. 3.

Then the flange 31 is caught by hooks 19 so that, when the device 28 is moved leftwardly as shown in FIG. 5, the end ring 26 may not be prevented from being detached from the hardened concrete pipe B.

Figure 7:
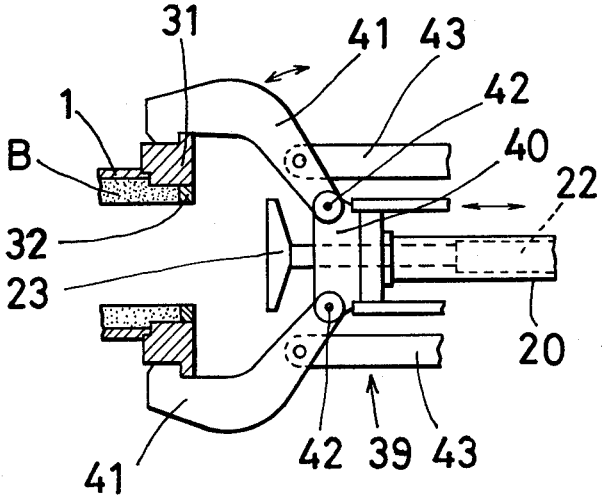
FIG. 7 is a plan view of a device for releasing a concrete pipe from a molding flask.

Now the end ring 26 is detached from the hardened concrete pipe B, cylindrical body 1 and flange 2 by moving the device 28 leftwardly as shown in FIG. 5. Then the end ring 26 is gripped by a device similar to the one shown in FIG. 7, and the adjustable jaws 12 are moved away from the bevel gears 33 so that the hook-shaped ends 13 may be disengaged from the annular groove 36 and the end ring 26 may be taken down to a conveyor 37.

Then the rollers 10 are lowered below the level of the conveyor 8 so that the molding flask A containing the concrete pipe B may be carried to a second workshop 38 by means of the conveyor 8. At the workshop 38, the hooks 41 are allowed to engage with the flange 31 by giving an axial push to the rods 43. Then the piston 22 is pushed out of the cylinder 20 so as to allow the push plate 23 to give an axial push to the hardened concrete pipe B.

The concrete pipe B which has been thrusted out of the molding flask A is carried to a desired place by means of a track 24.

From the foregoing, it is evident that the molding flasks A of the present invention can be provided with the clasps 5 of equal size irrespective of the diameters of the molding flasks A and that the distance between the axis of each bolt 4 and the bottom surface of the annular groove 36 can always be made equal irrespective of the diameters of the molding flasks A. This means that the device 28 can be used for the molding flasks A of various diameters.

While a preferred embodiment of the present invention has been disclosed, it is to be understood that it has been described by way of example only, various other modifications being obvious.

What are claimed are:

1. An apparatus for manufacturing concrete pipes comprising:

(a) a molding flask, said molding flask comprising a cylindrical body having a bell end and a spigot end, a flange secured to said bell end of said cylindrical body and having an inside annular shoulder and an outside annular shoulder, a plurality of bolts inserted through said flange so as to allow the axes of said bolts to run parallel with the axis of said cylindrical body, a clasp rotatably fitting on each of said bolts in abutment with said outside annular shoulder of said flange, a means for constantly pressing said clasp against said outside annular shoulder of said flange, a first end ring fitting in said flange and held in place by means of said clasps, said first end ring having an outwardly projecting portion which is provided with an annular groove in the surface facing said bolts, and a second end ring fitting in said spigot end of said cylindrical body;

(b) a device for detaching said first end ring from a concrete pipe hardened in said molding flask, said device comprising a means for subjecting said device to reciprocation in the axial direction of said molding flask, a plurality of threaded bolts arranged radially in such a manner that a plane formed thereby is made perpendicular to the axis of said molding flask and that the extension of the axis of said molding flask passes through the point where the axes of said threaded bolts intersect, a means engaging each of said threaded bolts and adapted for catching said outwardly projecting portion of said first end ring, and a means for giving a kick at said clasp, said means for giving a kick at said clasp being mounted on said means engaging each of said threaded bolts; and (c) a means for giving an inward push to said second end ring.

2. The apparatus as set forth in claim 1, wherein said means engaging each of said threaded bolts and adapted for catching said outwardly projecting portion of said first end ring comprises an adjustable jaw tapped to engage each of said threaded bolts and having a hook-shaped end pointing to the axis of said molding flask, a means for moving said adjustable jaws all together at the same speed toward or away from the axis of said molding flask.

3. The apparatus as set forth in claim 2, wherein said means for giving a kick at said clasp comprises a hydraulic cylinder secured to each of said adjustable jaws so as to allow the axis of said hydraulic cylinder to run parallel with said outside annular shoulder of said flange, a piston adapted to be pushed out of and drawn into said hydraulic cylinder and provided with a hook-shaped end piece, said end piece pointing to said outside annular shoulder of said flange, the length of said end piece and the distance between said end piece and said hook-shaped end of said adjustable jaw being determined so that, when said hook-shaped end engages with said annular groove provided in said outwardly projecting portion of said first end ring, said clasp can be caught by said end piece at a point located toward the edge of said outside annular shoulder of said flange.

* * * * *